US005356150A

United States Patent [19]

Lavallee et al.

[11] Patent Number: 5,356,150

[45] Date of Patent: Oct. 18, 1994

[54] GOLF BALL

[75] Inventors: Gerald A. Lavallee, Belchertown; Edward F. Mendrala, West Springfield, both of Mass.

[73] Assignee: Lisco, Inc., Tampa, Fla.

[21] Appl. No.: 92,435

[22] Filed: Jul. 14, 1993

[51] Int. Cl.[5] ..... A63B 37/14

[52] U.S. Cl. ..... 273/232

[58] Field of Search ..... 273/232; D21/205

[56] References Cited

U.S. PATENT DOCUMENTS

| | | | |
|---|---|---|---|
| Re. 25,427 | 7/1963 | Harkins | 273/230 |
| D. 107,066 | 11/1937 | Cavignac | 273/232 X |
| D. 228,394 | 9/1973 | Martin et al. | D34/5 QQ |
| D. 243,866 | 3/1977 | Shaw et al. | D34/5 QQ |
| D. 247,685 | 4/1978 | Haines et al. | D34/5 QQ |
| 878,254 | 2/1908 | Taylor | 273/232 |
| 906,932 | 12/1908 | Riblet | 273/233 |
| 922,773 | 5/1909 | Kempshall | 273/232 |
| 985,741 | 2/1911 | Harvey | 273/220 |
| 1,182,605 | 5/1916 | Wadsworth | 273/232 |
| 1,265,036 | 7/1918 | Bendelow | 273/233 |
| 1,286,834 | 12/1918 | Taylor | 273/232 |
| 1,418,220 | 5/1922 | White | 273/232 |
| 1,482,232 | 1/1924 | Hazeltine | 273/232 |
| 1,656,408 | 1/1928 | Young | 273/232 |
| 1,666,699 | 4/1928 | Hagen | 273/232 |
| 1,681,167 | 8/1928 | Beldam | 273/232 |
| 1,716,435 | 6/1929 | Fotheringham | 273/232 |
| 1,855,448 | 4/1932 | Hazeltine | 273/232 |
| 2,002,726 | 5/1935 | Young | 273/62 |
| 2,106,704 | 2/1938 | Davis | 273/62 |
| 2,643,125 | 6/1953 | Juve | 273/235 |
| 2,728,576 | 12/1955 | Martin et al. | 273/232 |
| 2,730,159 | 1/1956 | Semegen | 273/233 |
| 2,741,480 | 4/1956 | Smith | 273/227 |
| 2,861,810 | 11/1958 | Veatch | 273/213 |
| 2,997,302 | 8/1961 | Smith | 273/235 |
| 3,031,194 | 4/1962 | Strayer | 273/213 |
| 3,819,190 | 6/1974 | Nepela et al. | 273/232 |
| 3,819,768 | 6/1974 | Molitor | 260/897 B |
| 3,940,145 | 2/1976 | Gentiluomo | 273/218 |
| 4,090,716 | 5/1978 | Martin et al. | 273/232 |
| 4,141,559 | 2/1979 | Melvin et al. | 273/220 |
| 4,142,727 | 3/1979 | Shaw et al. | 273/232 |
| 4,201,384 | 5/1980 | Barber | 273/199 R |
| 4,235,441 | 11/1980 | Ciccarello | 273/213 |
| 4,256,304 | 3/1981 | Smith et al. | 273/60 B |
| 4,258,921 | 3/1981 | Worst | 273/232 |
| 4,266,773 | 5/1981 | Treadwell | 273/232 |
| 4,284,276 | 8/1981 | Worst | 273/232 |
| 4,346,898 | 8/1982 | Badke | 273/232 |
| 4,560,168 | 12/1985 | Aoyama | 273/232 |
| 4,653,758 | 3/1987 | Solheim | 273/232 |
| 4,660,834 | 4/1987 | Carrigan | 273/176 AB |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |

(List continued on next page.)

FOREIGN PATENT DOCUMENTS

| | | | |
|---|---|---|---|
| 192618 | 1/1983 | Australia . | |
| 4774 | of 1892 | United Kingdom | 273/62 |
| 4360 | of 1898 | United Kingdom | 273/232 |
| 20778 | of 1911 | United Kingdom | 273/232 |
| 3012 | of 1912 | United Kingdom | 273/232 |
| 22179 | of 1912 | United Kingdom | 273/232 |
| 645 | of 1914 | United Kingdom | 273/232 |
| 189551 | 9/1921 | United Kingdom | 273/232 |
| 377354 | 5/1931 | United Kingdom | 273/232 |
| 420410 | 1/1934 | United Kingdom | 273/62 |

*Primary Examiner*—George J. Marlo

*Attorney, Agent, or Firm*—Donald R. Bahr; John E. Benoit

[57] ABSTRACT

A golf ball having two hemispheres separated by an equator. Each hemisphere has an identical dimple pattern comprising a dimple-free area adjacent the equator, a plurality of substantially identical sections extending between the pole and the equator with each dimple pattern comprising a plurality of elongated dimples, each dimple having an axis extending at an angle relative to the equator between 0° and 90° in either direction. The majority of the dimples overlap at least one adjacent dimple.

4 Claims, 2 Drawing Sheets

U.S. PATENT DOCUMENTS

| | | | |
|---|---|---|---|
| 4,729,567 | 3/1988 | Oak et al. | 273/232 |
| 4,729,861 | 3/1988 | Lynch et al. | 264/219 |
| 4,744,564 | 5/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,787,638 | 11/1988 | Kobayashi | 273/232 |
| 4,804,189 | 2/1989 | Gobush | 273/232 |
| 4,813,677 | 3/1989 | Oka et al. | 273/232 |
| 4,830,378 | 5/1989 | Aoyama | 273/232 |
| 4,840,381 | 6/1989 | Ihara et al. | 273/232 |
| 4,844,472 | 7/1989 | Ihara | 273/232 |
| 4,848,766 | 7/1989 | Oka et al. | 273/232 |
| 4,858,923 | 8/1989 | Gobush et al. | 273/62 |
| 4,867,459 | 9/1989 | Ihara | 273/232 |
| 4,869,512 | 9/1989 | Nomura et al. | 273/232 |
| 4,877,252 | 10/1989 | Shaw | 273/232 |
| 4,880,241 | 11/1989 | Melvin et al. | 273/232 |
| 4,886,277 | 12/1989 | Mackey | 273/232 |
| 4,915,389 | 4/1990 | Ihara | 273/232 |
| 4,915,390 | 4/1990 | Gobush et al. | 273/232 |
| 4,921,255 | 5/1990 | Taylor | 273/232 |
| 4,925,193 | 5/1990 | Melvin et al. | 273/232 |
| 4,932,664 | 6/1990 | Pocklington et al. | 273/232 |
| 4,936,587 | 6/1990 | Lynch et al. | 273/232 |
| 4,949,976 | 8/1990 | Gobush | 273/232 |
| 4,960,282 | 10/1990 | Shaw | 273/232 |
| 4,960,283 | 10/1990 | Gobush | 273/232 |
| 4,968,038 | 11/1990 | Yamada | 273/232 |
| 4,971,330 | 11/1990 | Morell | 273/232 |
| 4,973,057 | 11/1990 | Morell | 273/232 |
| 4,974,853 | 12/1990 | Morell | 273/232 |
| 4,974,854 | 12/1990 | Morell | 273/232 |
| 4,974,855 | 12/1990 | Morell | 273/232 |
| 4,974,856 | 12/1990 | Morell | 273/232 |
| 4,979,747 | 12/1990 | Jonkouski | 273/232 |
| 4,982,964 | 1/1991 | Morell | 273/232 |
| 4,991,852 | 2/1991 | Pattison | 273/232 |
| 4,998,733 | 3/1991 | Lee | 273/232 |
| 5,009,427 | 4/1991 | Stiefel et al. | 273/232 |
| 5,009,428 | 4/1991 | Yamagishi et al. | 273/232 |
| 5,016,887 | 5/1991 | Jonkouski | 273/232 |
| 5,018,741 | 5/1991 | Stiefel et al. | 273/232 |
| 5,024,444 | 6/1991 | Yamagishi et al. | 273/323 |
| 5,033,750 | 7/1991 | Yamagishi et al. | 273/272 |
| 5,044,638 | 9/1991 | Nesbitt et al. | 273/232 |
| 5,046,742 | 9/1991 | Mackey | 273/232 |
| 5,060,953 | 10/1991 | Bunger et al. | 273/232 |
| 5,060,954 | 10/1991 | Gobush | 273/232 |
| 5,062,644 | 11/1991 | Lee | 273/232 |
| 5,064,199 | 12/1991 | Morell | 273/232 |
| 5,072,945 | 12/1991 | Oka et al. | 273/232 |
| 5,078,402 | 1/1992 | Oka | 273/232 |
| 5,080,367 | 1/1992 | Lynch et al. | 273/232 |
| 5,158,300 | 10/1992 | Aoyama | 273/232 |
| 5,200,573 | 4/1993 | Blood | 273/232 |

GOLF BALL

This invention relates generally to the dimple configuration on the surface of a golf ball and more particularly to an elongated dimple configuration and the method of obtaining that configuration.

Golf balls are now being produced having various dimple patterns, dimple sizes, and geometric dimple patterns. Generally speaking, all of these dimples are configured so as to have a substantially constant geometric surface. Whether circular or multi-sided, the dimples are designed so that the geometrical configuration of each dimple is substantially the same regardless of its size. In this type of dimple arrangement, the dimples are normally configured in some pattern such as an octahedron, dodecahedron, or the like, or are configured so as to provide sections within the hemisphere, whether those sections number four, or six, or whatever desired configuration. Normally, the dimples are arranged in a desired pattern within each section and then this pattern is repeated for each section. The standard procedure is that each hemisphere has the same number of dimples and in substantially the same pattern and the hemispheres may be rotated with respect to each other depending upon the position of the mold halves.

The present invention, in attempting to obtain maximum dimple coverage on a golf ball, departs from the standard geometrical configuration of each dimple and is designed so that the dimples are essentially elongated.

SUMMARY OF THE INVENTION

The present invention relates to a golf ball having a plurality of dimples formed on the spherical surface of the golf ball, with the surface defining opposite poles and an equator midway between the poles so as to divide the surface into two hemispheres. The hemispheres have substantially the same dimple pattern and each dimple pattern comprises a dimple-free area surrounding the pole, a dimple-free area adjacent the equator, and a plurality of substantially identical sections extending between the pole and the equator, with each of said sections having a dimple pattern which comprises a plurality of elongated dimples. The axis of each dimple may extend in a direction between a line parallel with the equator and a line between the equator and the pole. The majority of the dimples overlap at least one adjacent dimple. The method used for obtaining this pattern is to locate a plurality of substantially similar geometric dimples on each of the hemispheres and move the outline of the dimples tangentially along the surface of the ball in the selected direction so as to form elongated dimples in the surface of the ball.

DETAILED DESCRIPTION OF THE PREFERRED EMBODIMENT

Figure 1:
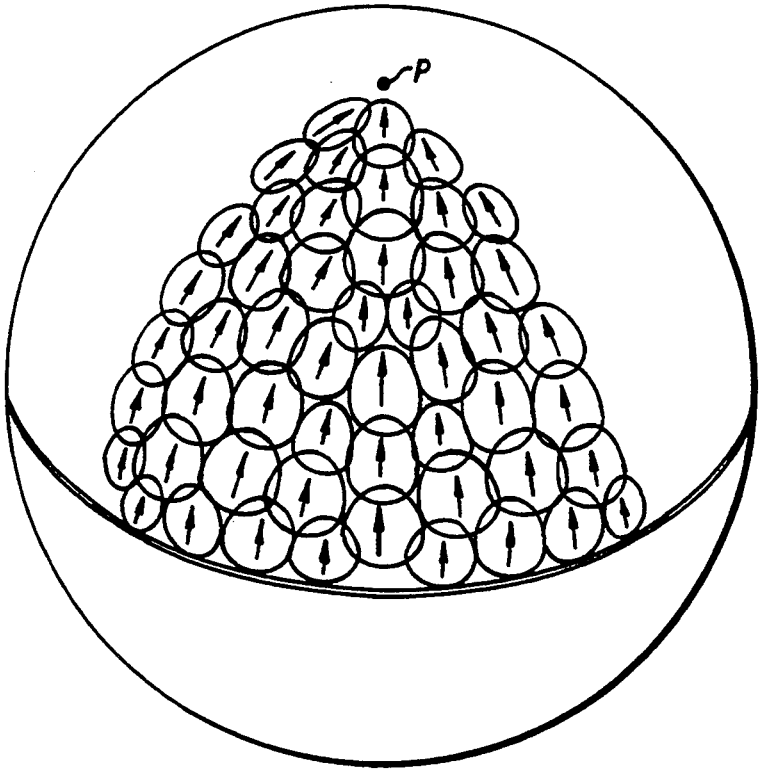
FIG. 1 is a schematic illustration of a section of each hemisphere which represents the repeated sections of the golf ball.

Referring to FIG. 1, there is illustrated one of the sections which are used to provide the dimples on the surface of a golf ball. In this particular illustration, each hemisphere is divided into four substantially equal sections, with each section having the same number of dimples and arranged in the same configuration. The arrows shown in the dimples 23 are used to illustrate axes of the elongated dimples.

In order to illustrate the overlap of the various dimples, overlapping lines have been used to illustrate the configuration of each dimple if it were individually placed on the ball without intersecting adjacent dimples.

It is to be understood that FIG. 1 represents one quadrant, or one-fourth, of one hemisphere and that the other three quadrants are substantially duplicates of that shown in FIG. 1 and the quadrants in the other hemisphere are also substantially the equivalent of FIG. 1.

In the configuration shown in FIG. 1, the ball comprises a quadrant configuration with each quadrant having 51 dimples so that the entire ball has a total of 408 dimples.

As will be quite obvious from the showing of FIG. 1, there is a space between the dimples nearest the equator and the equator itself so as to provide the standard flashline area when using a two-piece mold. Additionally, in this particular ball configuration, the pole P in each hemisphere is dimple-free.

Figure 2:
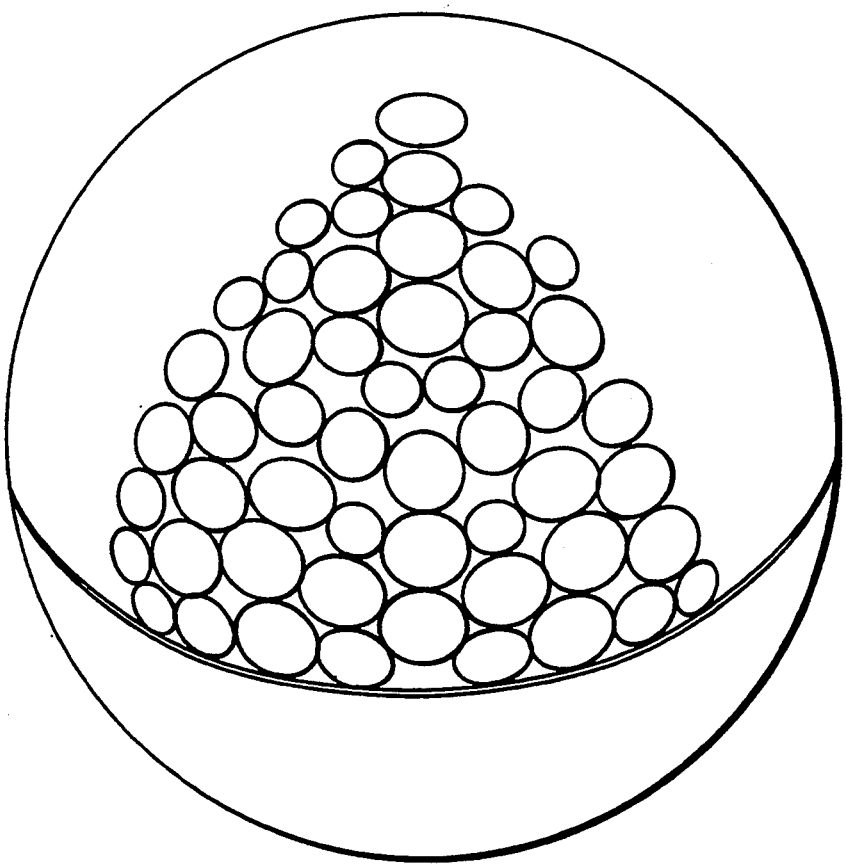
FIG. 2 is a schematic illustration of the basic pattern which is used to develop the section as shown in FIG. 1.
Figure 3:
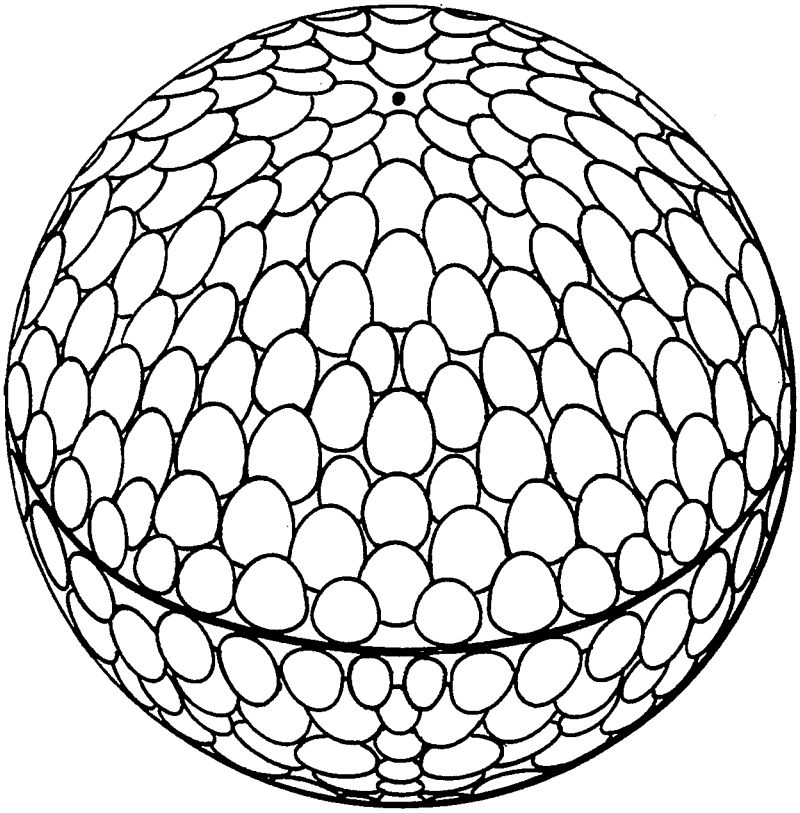
FIG. 3 is a schematic off-equator illustration indicating the outline of individual dimples without including overlap.

FIGS. 2 and 3 illustrate the method for providing the dimple pattern as shown in FIG. 1. In FIG. 2, a plurality of circular dimples have been arranged on a section of a ball in the configuration wherein there are four quadrants to each hemisphere, with each quadrant having the same number of dimples. In order to properly illustrate the method of reaching the desired dimple configuration of FIG. 1, FIGS. 2 and 3 also relate to a ball which has 408 dimples.

Each of the dimples in FIG. 2 are moved tangentially to the surface of the ball in the direction of the pole P. This movement results in an elongated dimple with each dimple overlapping at least one adjacent dimple so that at the overlap the dimples share a common dimple edge. As will be obvious from viewing this particular procedure for making the dimples, the lower half of each of the dimples will have a substantially constant radius over the 180degrees arc of the dimple nearest the equator. Of course, as the dimples intersect and overlap, the configuration will naturally be changed.

FIG. 3 is a schematic off-equator intermediate illustration of the development of the dimple configuration of FIG. 1. The pattern as disclosed in FIG. 2 has been adjusted as described below. In this illustration, all of the dimples are effectively elongated so that an axis drawn centrally along the lines of each dimple in a direction from the equator toward the pole indicates the direction of elongation of the dimples. As can be seen, with this configuration each dimple overlaps at least one adjacent dimple. In this intermediate illustration, the complete outline of each dimple is shown so as to illustrate the effect of dimple elongation. This dimple overlap is shown in dotted lines in the actual final section of FIG. 1 so as to correlate with the illustration of FIG. 3.

Figure 4:
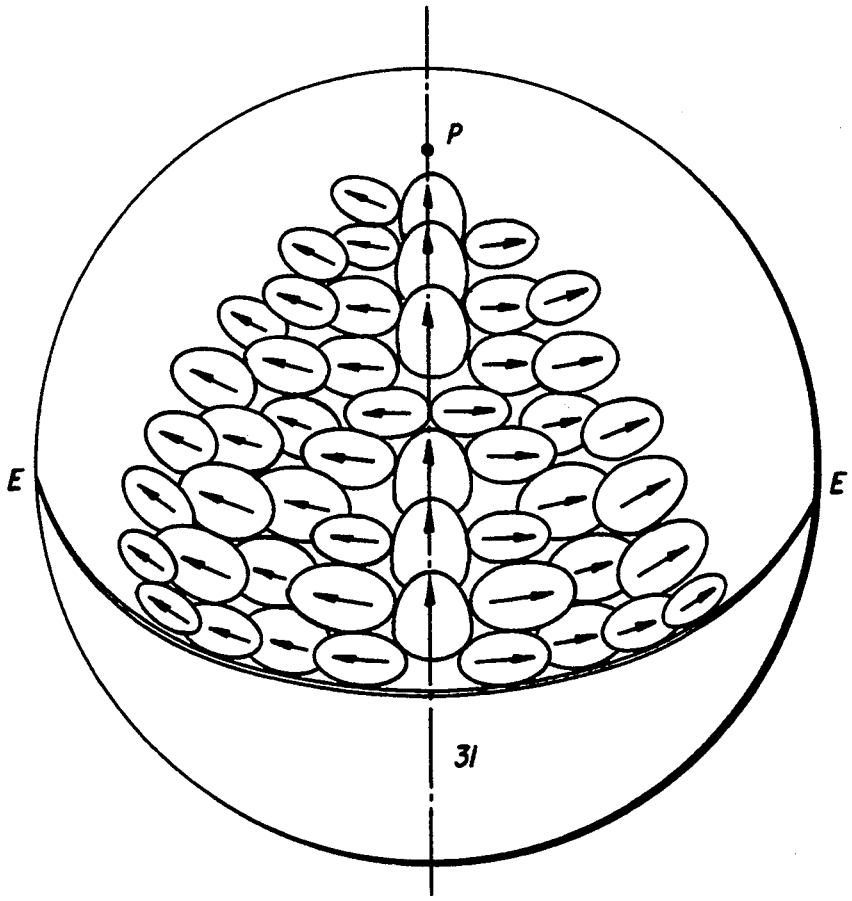
FIG. 4 discloses a modification of the section illustrated in FIG. 1.

In the modification of FIG. 4, the basic pattern as illustrated in FIG. 3 is also used. As indicated by the arrows, the dimples left of centerline 31 have been elongated to the left while the dimples to the right of centerline 31 have been elongated to the right. The axes of these dimples are substantially parallel to equator E—E. The dimples along the centerline have axes elongated toward the pole in the manner described relative to FIGS. 1 and 2.

Various patterns can be used with dimples having elongated axes which extend in directions between lines parallel to the equator and lines lying in a direction between the equator and the pole, i.e., an angle relative to the equator between 0½ and 90½ in either direction.

While two particular patterns have been shown to illustrate the concept of the present invention, it is to be understood that the use of elongated dimples as created by the method shown is applicable to any dimple pattern which is basic to a hemisphere of a golf ball. Obviously, the dimples do not need to be of the same size and can be arranged in a different pattern.

The above description and drawings are illustrative only since many modifications could be provided relative to dimple number and size and configuration without departing from the invention, the scope of which is to be limited only by the following claims.

We claim:

1. A spherical golf ball having a plurality of dimples formed on the spherical surface thereof, said surface defining a pole in each hemisphere thereof and an equator midway between said poles dividing the surface into two hemispheres, each of said hemispheres having substantially the same dimple pattern, said dimple pattern in each hemisphere comprising a dimple-free area adjacent said equator;

a plurality of substantially identical sections extending between a pole and said equator, each of said sections having a dimple pattern comprising a plurality of elongated dimples, each of said dimples having an elongated axis extending at any angle relative to said equator from 0° to 90° in either direction; and the majority of said dimples overlapping at least one adjacent dimple.

2. The golf ball of claim 1 further comprising a dimple-free area surrounding the pole in each hemisphere.

3. The golf ball of claim 1 wherein all of said dimples overlap.

4. The golf ball of claim 1 wherein each of said dimples has its longitudinal axis extending from said equator toward said pole.

* * * * *